US006991734B1

(12) United States Patent
Smith et al.

(10) Patent No.: US 6,991,734 B1
(45) Date of Patent: Jan. 31, 2006

(54) SOLIDS RETENTION IN STORMWATER SYSTEM

(75) Inventors: Jonathan F. Smith, Waterford, CT (US); Bryan A. Coppes, Old Saybrook, CT (US)

(73) Assignee: Infiltrator Systems INC, Old Saybrook, CT (US)

( * ) Notice: Subject to any disclaimer, the term of this patent is extended or adjusted under 35 U.S.C. 154(b) by 37 days.

(21) Appl. No.: 10/813,887

(22) Filed: Mar. 31, 2004

Related U.S. Application Data

(60) Provisional application No. 60/459,478, filed on Apr. 1, 2003.

(51) Int. Cl.
*E03F 1/00* (2006.01)

(52) U.S. Cl. ..... 210/747; 210/170; 210/254; 210/265; 210/532.1; 405/43; 405/46; 405/50

(58) Field of Classification Search ..... 210/170, 210/747, 254, 265, 266, 299, 532.1, 804, 210/806; 405/36, 43, 45, 46, 50
See application file for complete search history.

(56) References Cited

U.S. PATENT DOCUMENTS 3,919,848 A * 11/1975 Sullivan ..... 210/170
4,588,325 A * 5/1986 Seefert ..... 405/43
4,919,568 A * 4/1990 Hurley ..... 405/43
5,322,387 A * 6/1994 Heine et al. ..... 405/43
5,419,838 A * 5/1995 DiTullio ..... 210/747
5,433,845 A * 7/1995 Greene et al. ..... 210/170
5,746,911 A * 5/1998 Pank ..... 210/170
5,921,711 A * 7/1999 Sipaila ..... 405/46
6,461,078 B1 * 10/2002 Presby ..... 210/170
6,464,865 B2 * 10/2002 Tipton et al. ..... 210/170
6,612,777 B2 9/2003 Maestro ..... 405/49
6,719,490 B2 4/2004 Maestro ..... 405/46

OTHER PUBLICATIONS

Infiltrator Systems, Inc, "Stormwater Design and Maintenance Manual", Aug. 1993, pp. 9-10.
Vortechnics, Inc "Total Stormwater Solutions" Catalog, Date Unknown, pp. 1-9.
Hancor, Inc "Stormwater Quality Unit" Brochure (2003) 6 pages.
H.I.L. Technology, Inc "Downstream Defender" Brochure (2001) 4 pages.
Stormwater Management, Inc. "Stormgate Separator Vault", Drawing & Specification Sheet (Dec. 27, 2001) 1 page.

* cited by examiner

*Primary Examiner*—Christopher Upton
(74) *Attorney, Agent, or Firm*—C. Nessler

(57) ABSTRACT

Apparatus for receiving and dispersing stormwater beneath the earth surface is comprised of an array of chambers, preferably having arch shape cross section, buried in crushed stone. Surface stormwater flows first through a diverter, then into a solids retention subsystem (SRS), and then into the array of chambers, which is spaced apart in the stone from the SRS. The SRS chambers are layered with geotextile or other filtering media. Solids entrained in the stormwater are retained in the SRS by a combination of settling and filtering actions. If the stormwater inflow exceeds the capacity of the SRS, the water level rises in the diverter to the point where it flows through a bypass line, directly to the chambers of the array.

20 Claims, 4 Drawing Sheets

SOLIDS RETENTION IN STORMWATER SYSTEM

This application claims the benefit of application Ser. No. 60/459,478 filed Apr. 1, 2003.

TECHNICAL FIELD

The present invention relates to mechanical systems that receive and temporarily store stormwater beneath the surface of the earth, so the water can subsequently be dispersed within the earth, or discharged to a water course or other receiving point.

BACKGROUND

One way of handling stormwater runoff, such as from streets or a large shopping center parking lot, is to collect the water by means of surface drains, and send it to an underground structure, where it can be detained and subsequently released in a controlled manner to a water course or municipal storm sewer, and or so it percolates over time into the surrounding soil. Underground structures which have been used heretofore for the purpose comprise corrugated pipes, arch shape cross section molded chambers, concrete galleries and the like. Commonly, they are buried in a bed of stone or gravel, and with the stone interstices they provide void space within the earth, for receiving stormwater. For examples of apparatus used for receiving stormwater see Moore et al. Pat. No. 5,890,838, Maestro Pat. No. 6,361,248.

Stormwater typically carries with it debris, such as sand, paper and plastic things, and other miscellaneous matter, which had accumulated on the surface being drained. Catch basins and other devices are commonly used to trap or settle out such debris, to prevent large amounts from entering the subterranean system. For the debris that nonetheless enters and accumulates in the underground stormwater systems, access ports and manholes provide access for cleaning.

Increasingly, there are regulatory limits on the total suspended solids TSS content of stormwater which is discharged to streams or municipal storm sewer systems from parking lots and the like, and from stormwater detention systems used with such. But it is not so easy to prevent finer solids from entering the underground systems, or to retain them in the system in a way which enables them to be removed, so the system does not become gradually clogged. The prior art comprises various devices and methods, including Stever Pat. No. 6,350,374, which describes apparatus comprising a series of baffles; and, Stewart Pat. No. 5,322,629 which describes flowing the storm water through a layer of leaf compost material. Applicants are unaware of widespread use of such. So, there is a need for improvement in stormwater systems, to isolate or contain within a system debris which enters with stormwater, so it can be later largely removed, and so it is prevented from discharging to a watercourse.

SUMMARY

An object of the invention is to improve the handling of stormwater which is flowed into underground chambers or cavities, by capturing, and holding for convenient subsequent removal, solids which entrained in the stormwater. Another object is to enhance the long term performance of stormwater systems by avoiding progressive clogging of the systems.

In accord with the invention, stormwater handling apparatus is comprised of an array of chambers buried within permeable media, such as crushed stone. The chambers may be any of a variety of cross sectional shapes. Stormwater from surface drains flows into a solids retention subsystem (SRS), which is buried beneath the surface of the earth within the permeable media, and then to the array of chambers. The SRS settles and filters the stormwater, and discharges partly clarified water, so it flows through a quantity of the permeable media, to one or more chambers of the spaced apart array. The chambers which comprise the SRS may be like those used in the array. Preferably, the SRS comprises a string of arch shape cross section perforated wall chambers which have geotextile running along the exterior sidewalls and across the crushed stone at the bottom of the arch. Preferably, a combination of woven and non-woven geotextiles is used. Substances that capture hydrocarbons or metal ions may be contained within the SRS. Water which flows to the array is detained in the chambers and media and percolated over time into the surrounding earth, and or it is controllably released to a storm sewer, water course, or other place.

In further accord with the invention, the stormwater first flows through a diverter, which is upstream of the solids retention subsystem (SRS). In the diverter, some of the coarser solids in the water settle out, and the water flows through a first outlet to the SRS. If the flow capacity of the SRS is exceeded such as when stormwater flow is very large, the diverter channels the excess water through a second outlet, so it runs down a bypass line which is connected directly to the chambers of the array. Thus, from the user standpoint, the surface draining function is not impeded.

The solids which are retained in the SRS can be conveniently removed during maintenance operations, by use of access points at the end of the chamber row which comprises the unit, when there is no storm. The SRS lessens the amount of solids which flows into the chambers of the array, and minimizes degradation of their capacity over time, which could other wise occur. At the same time, maintenance is made easier, because the solids are concentrated in one spot, rather than dispersed within the array.

The foregoing and other objects, features and advantages of the invention will become more apparent from the following description of preferred embodiments and accompanying drawings.

DESCRIPTION

The present invention is described in terms of use of arch shape cross section plastic molded open-bottom chambers having perforated sidewalls, such as Stormtech® Model SC310 or Model 740 chambers (Stormtech LLC, Wethersfield, Conn.). Chambers like those of Stormtech are described in patent application Ser. No. 09/849,768 of Krueger et al., filed May 24, 2001, the description and drawings of which are hereby incorporated by reference.

Other commercial arch shape molded plastic chambers may be used in substitution. And other kinds of void-creating structures may be used in substitution of arch shape cross section chambers. For instance, use may be made of commercial corrugated round (circular, oblong, and other closed cross section shape) perforated non-metal or metal pipe; as well as arch shape structures, galleries, and other devices of concrete or metal, and so forth, as known in the field, or still to be introduced. The term "chamber" as used in claiming the invention here is intended to encompass the generality of such devices.

Figure 1:
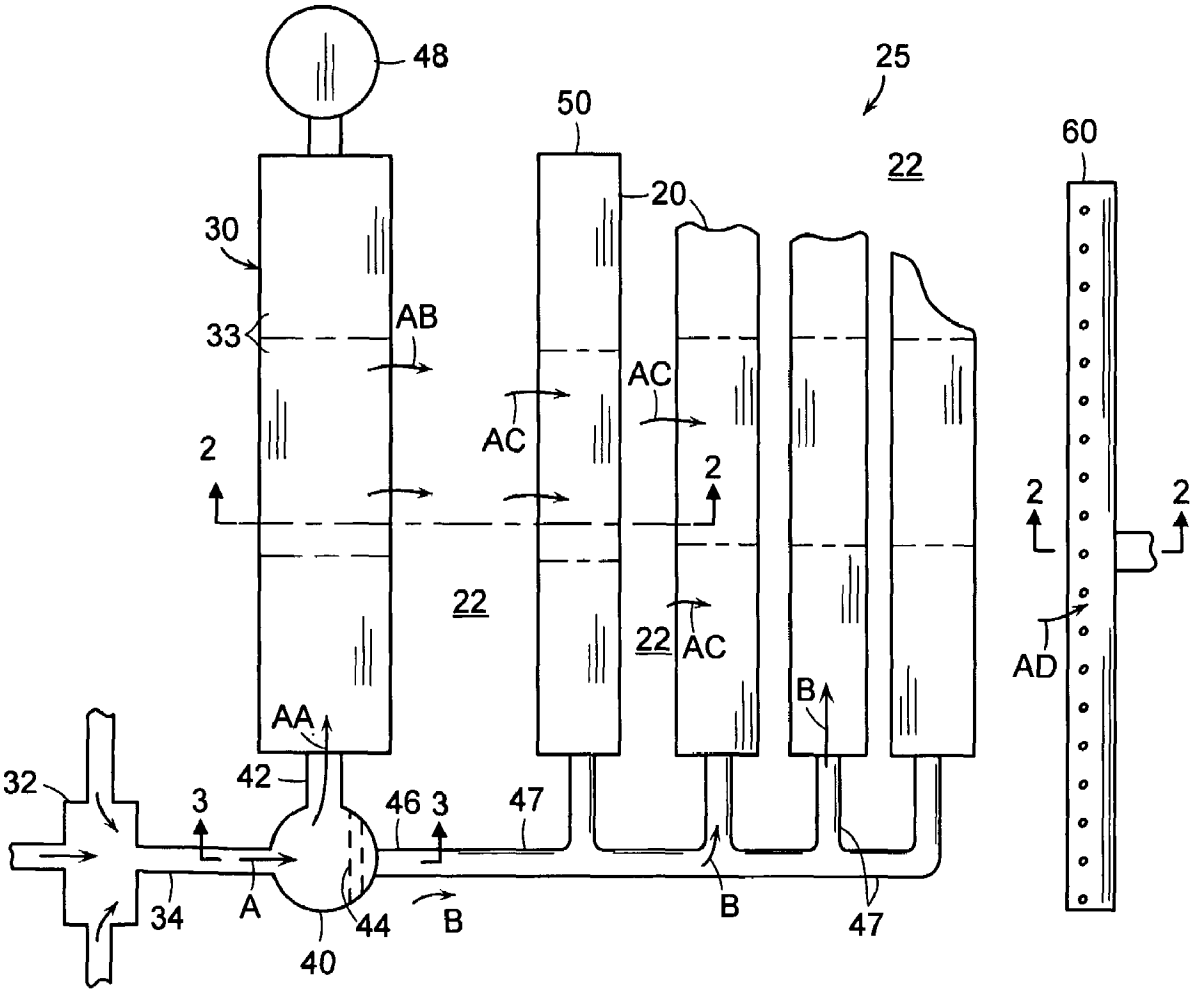
FIG. 1 is a plan view of a stormwater handling system.
Figure 2:
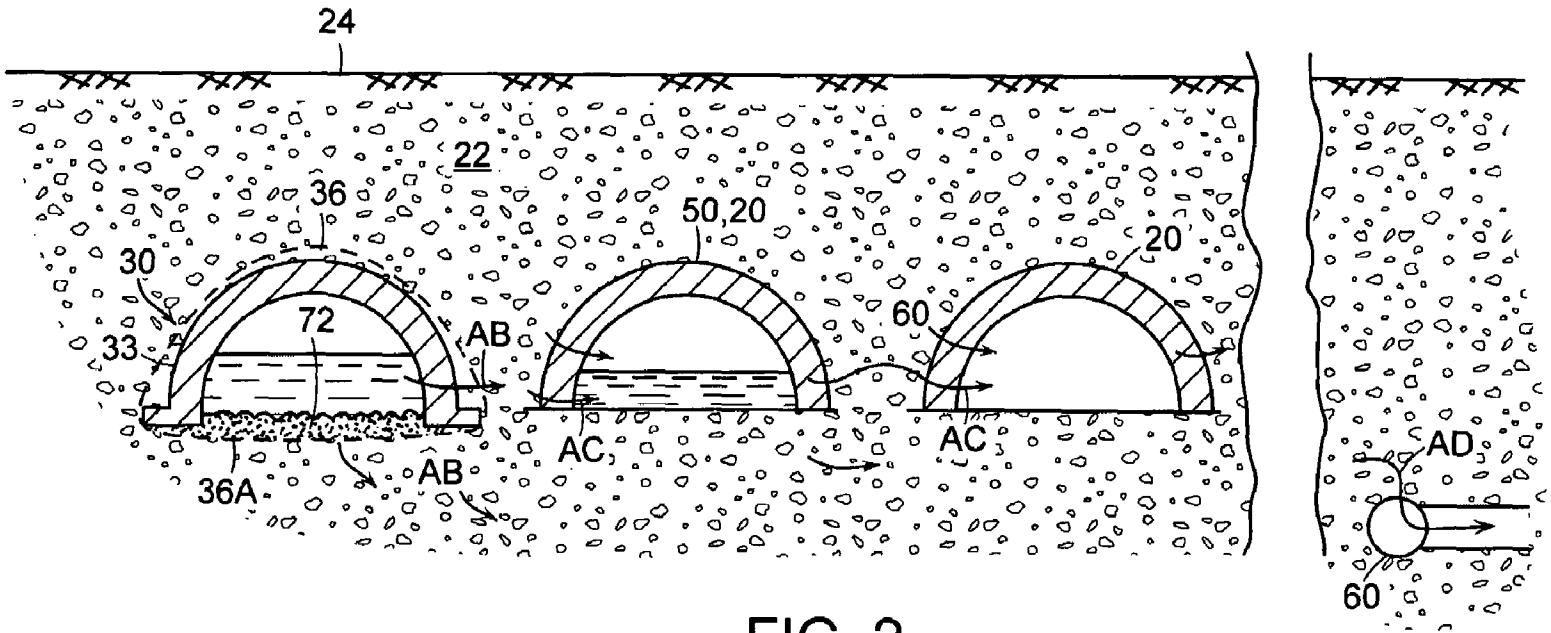
FIG. 2 is an elevation cross section view through a portion of the system shown in FIG. 1.

FIG. 1 is a semi-schematic plan view of a subterranean stormwater system. FIG. 2 is a vertical elevation cross section view through a portion of the system. An array 25 of parallel rows of Stormtech perforated wall chambers 20 is buried beneath the surface 24 of the earth, i.e., under an automobile parking lot, within angular crushed stone 22, or other suitable water permeable media, such as gravel, round stone, slag, etc. Depending on the inflow rate and particular stormwater system design, water is temporarily stored in the chambers 20 and surrounding crushed rock interstices, and then dispersed over time. Typically, there is always some dispersion by percolation into the earth surrounding the crushed stone; and, often there is discharge through an outflow pipe at a predetermined maximum rate, to a municipal storm sewer, pond, watercourse or other receiving point.

In use, stormwater which falls onto surface 24 flows into conventional surface drains, such as a familiar combination of spaced part catch basins, interconnected by buried pipes. Handling stormwater collected by other means, and in other applications, is within the scope of the invention. Collection basin 32 in FIG. 1 is suggestive of such a system. Water from catch basins may also flow through one or more commercial settling devices, before entering the apparatus of the invention, to settle out the most coarse and heavy solids and floating matter.

The stormwater carrying the remaining solids flows from the collection basin 32 to optional diverter 40, where some more coarse debris settles out. In this description, the term solids is used to refer to any of various undissolved materials that are entrained by stormwater, including those variously referred to as suspended solids and settlable solids. The stormwater from the diverter flows to solids retention subsystem (SRS) 30, for example a string of perforated wall chambers 33 like those used in array 25. The SRS removes a substantial fraction of solids from the stormwater. The fraction will depend on the character of the solids, the fine-ness of the filtering function of the SRS, and the water flow rate. Resultant partially clarified water then flows generally laterally through a mass of permeable media, toward the nearest chamber 50 of a parallel array 25 of chambers 20. The water flowing from the SRS is referred to here as being partly clarified, or more simply, clarified. The meaning intended for either term, without distinction, is that the solids load in the stormwater has been decreased. Particularly when the solids are very fine, e.g. silt, commercial geotextiles used in the invention will be insufficient to remove all solids.

If the stormwater apparatus design and use intends that water peroclation over time within the soil, the water accumulates in the interstices of the gravel and within the chambers 20, until that occurs. If the system design intends that some portion of the water be delivered to a municipal storm sewer watercourse or other receiving point, a perforated collection pipe 60 is buried in the crushed stone, preferably spaced apart from the row of chambers 20 which is farthest from the SRS. See FIG. 2.

Outflow from the collection pipe 60 may be regulated by pipe diameter, orifice plate of other means, to meet regulatory discharge rate requirements. The last row of chambers 20 may function as the collection pipe. Alternately, a plenum, connected to chambers 20 by pipes, may be used.

Figure 3:
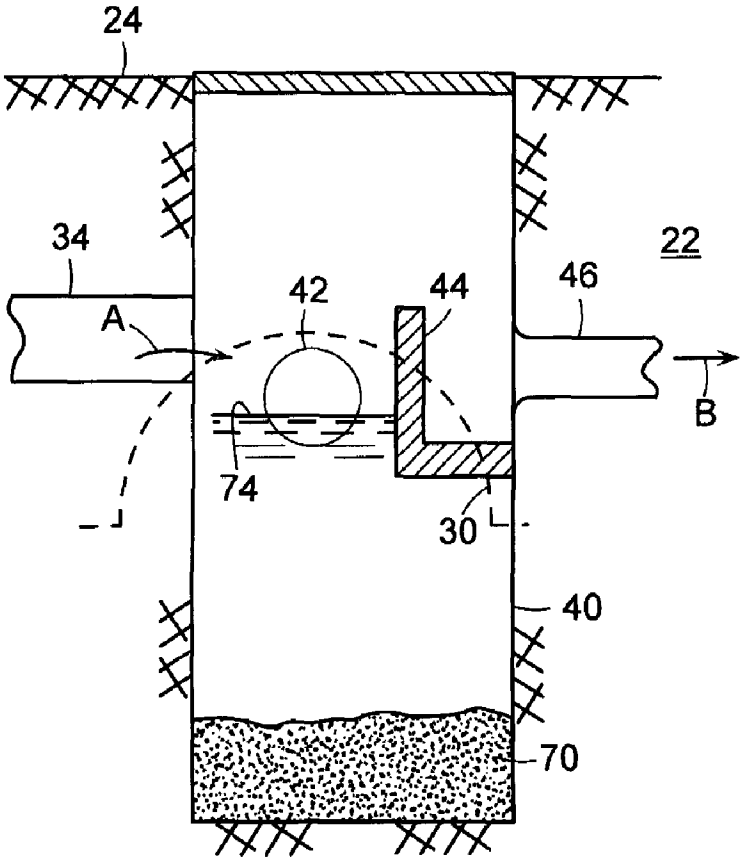
FIG. 3 is an elevation cross section view of a diverter.

As shown in FIGS. 1 and 2, stormwater flows by means of pipe 34 to optional diverter 40, as shown by arrow A, and, then by means of first outlet pipe 42 into solids retention subsystem SRS 30, as shown by arrow AA. FIG. 3, discussed further below, shows in vertical cross section a diverter 40. Coarse debris 70 that settles to the bottom of the diverter is removable during maintenance activities. Other prior art sedimentation devices may be used upstream of diverter 40 or in substitution thereof. Diverter 40 may incorporate other features than those shown; for instance, baffles and or swirling flow motion.

The size and shape of SRS 30 compared to diverter 40 is preferably such that the flow velocity in the SRS is lower than in the diverter. So, the finer suspended solids will tend to flow into, and settle out in the SRS, particularly in the portion which is distant from inflow pipe 42. As water flows from the SRS into the surrounding media, finer debris which is still suspended is filtered out by filter fabric 36 or substitutional permeable media placed next to the chamber which media is finer than the preponderant crushed stone 22.

As indicated by FIG. 2, SRS 30 is preferably comprised of a string, or length, of interconnected arch shape cross section perforated wall, open bottom, chambers 33. A layer 36 of non-woven plastic filter fabric or geotextile runs along the perforated sidewalls of chambers 33. A layer 36A of geotextile runs across the crushed stone at the base or open bottom of the chambers 33 of the SRS. The material 36A is in part chosen for its toughness, to resist cleaning processes, as described below. A Type 600X woven polypropylene geotextile may be used for layer 36A, from T.C. Mirafi Co., Pendergrass, Ga. It will have a filtering rating nominally consistent with US Sieve Size 40–70 (0.2–0.43 mm opening dimension) and will meet AASHTO M288 Class 2 standard. Mirafi Type 160 non-woven polypropylene geotextile may be used for the sidewall layer 36. It filters finer particles than the woven bottom layer material; and, preferably conforms with AASHTO Class 1. Of course, to the extent the end caps at the ends of a chamber string of the SRS allow significant stormwater outflow, they also can be layered externally with geotextile like that used for the sidewalls. The SRS may also be configured to function without filter media surrounding the chambers. For example, particularly with reference to the round pipe embodiment shown in FIG. 5, the SRS may comprise one or more chambers which have walls with very fine slots or other perforations, or integral screening, so that the walls themselves perform the filtering function.

In an alternate embodiment, a low permeablility or impermeable plastic membrane may be used across the bottom of SRS, so that essentially all the water is made to flow out the sidewalls, and to reduce the possibility of scouring due to stormwater flow or cleaning operations. In another embodiment of the invention, the geotextile at the sidewall and or the base may be replaced by or supplemented with a layer of specially tailored grain size of media, e.g. fine sand, chosen for its ability to function as a filter. In still another embodiment, the SRS may be configured to capture dissolved pollutants, for instance to capture hydrocarbons or metal ions. For example, granular polymer material, such as the kind used in Model 3100 Streamguard (Bowhead Manufacturing Co. LLC, Seattle, Wash.), may be placed within the chambers. If the dissolved-pollutant capturing materials are particulates they may be flowed with water into a newly installed, or newly cleaned, chamber, so they accumulate on the layers of geotextile, for example in a manner similar to that use to pre-coat fibrous filters in industrial operations. Likewise, other materials such as cation or anion exchange agents, such as familiar resins and zeolites, in granular or mat forms, may be similarly placed, for capturing certain metal ions. In carrying out this embodiment, it will be preferred to use an impermeable membrane across the bottom of an arch shape chambers, or to use round cross section chambers, in the SRS.

In a SRS which has a geotextile layer 36A across the bottom of the arch, some water will flow downwardly into the stone and earth below. Depending on the water volume, another portion of the water flows through the sidewall perforations and associated geotextile. Water from the SRS flows diffilusedly through the crushed stone to the nearest spaced apart row of chambers 20, as indicated by arrows AB. A substantial amount of solids in the water is left behind in the SRS. Water AB which enters or goes around the first chamber row 50 may continue flowing through crushed stone 22 to other chambers 20, as indicated by arrows AC.

Figure 5:
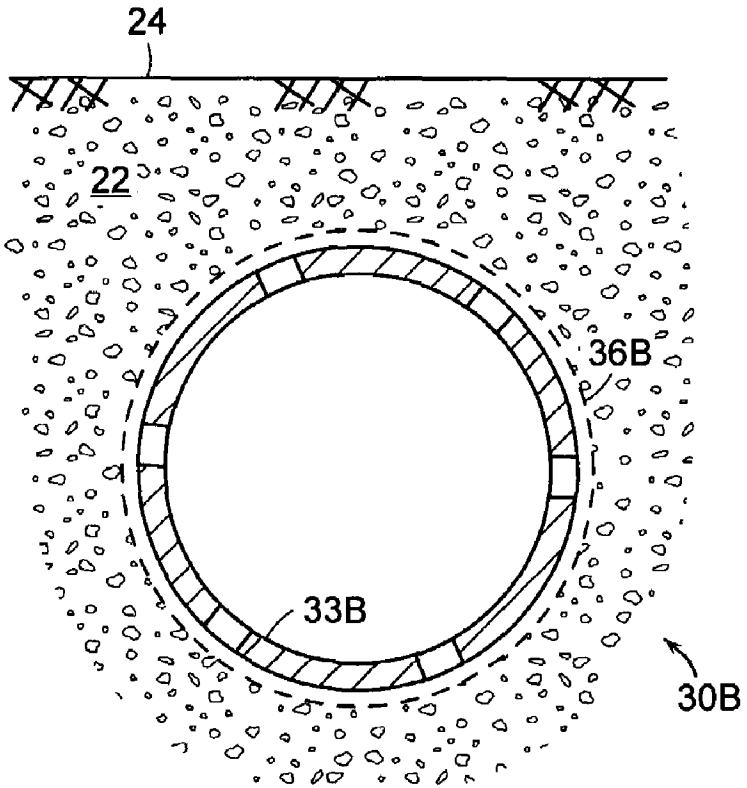
FIG. 5 is an elevation cross section view of a solids retention subsystem comprising a round pipe.

When stormwater is actually flowing into the invention system, the interior of SRS 30 functions as a sump or stagnation zone, since there is reduced flow velocity and resultant settling and collection of solids 72 along the bottom of the SRS, compared to the upstream settling devices, including diverter 40. See FIG. 2. It is expected that often water may accumulate in SRS 30 as suggested in FIG. 2, when the inflow exceeds flow capacity of the SRS or the system as a whole. Thus, for functional flow capacity reasons, it is preferred to have chambers with perforated sidewalls. However, the invention will work even if the arch shape cross section chamber sidewalls are not perforated, and water flow is only downward. FIG. 5 shows, as another embodiment, how SRS 30B may comprise corrugated perforated pipe 33B surrounded by geotextile filtering fabric 36B in substitution of arch shape cross section chambers. Stormwater flowing from SRS 30B can be in all vertical plane directions, depending on how much accumulates in the SRS.

With reference again to FIG. 1 and FIG. 3, if SRS 30 cannot handle the volume of stormwater flow, the SRS inflow water will back up in pipe line 42, and thus into diverter 40. At a certain point the water level 74 in the diverter will rise until it overflows weir 44, and then the water will flow out the second outlet pipe 46, to an associated piping system 47, and directly into chambers 20 of the array 25. In substitution of the weir, the elevation of the outlet of bypass pipe 46 may simply be higher than the elevation of the primary outlet pipe 42, running to the SRS. Typically, the loading of solids in stormwater is greatest during the so-called first flush, or the first rush of stormwater at the onset of storm rainfall. Therefore, a premise of the diverter feature is that, should the capacity of SRS 30 be exceeded, that will occur after the first flush; and, that fraction of water that might flow through the bypass system can be expected to have relatively favorable (low) solids content. Other configuration of diverter may be used in the invention. While undesirable from the standpoint of maintenance, a mechanical or electro-optical level sensing system may be used to gage water level in the SRS or diverter, and open or close a gate valve along the path running to bypass system 47.

During ordinary use, when there is no flow through the bypass piping 46, 47, the preponderance of solids which enter diverter 40 will flow into solids retention subsystem SRS 30 and accumulate there, along the bottom and within the filter fabric or other media along the sidewalls. The solids captured by the fabric at the sidewalls may fall to the bottom of the SRS arch shape cross section chamber string, when the storm ends and water flow ceases, depending on the size and agglomerating tendencies of the solids. At times when there is no stormwater flow, the captured debris may be removed using common cleaning equipment, such as vacuums and water jets. Access to the interior of interconnected chambers of SRS 30 for such purpose may be obtained through the top of diverter 40, or by opposite end access manhole 48. Inspection ports are not shown, but they will optionally be provided at points along the SRS length, so the interior can be inspected. Less preferably, SRS may be comprised of chambers of the type shown in U.S. Pat. No. 5,087,151 to DiTuillo. Such chambers have end walls, and a string of chambers is made by interconnection using short lengths of pipes. Those types of chambers cannot conveniently be jet-cleaned from the ends, but may be accessed by vertical ports into each chamber.

Figure 4:
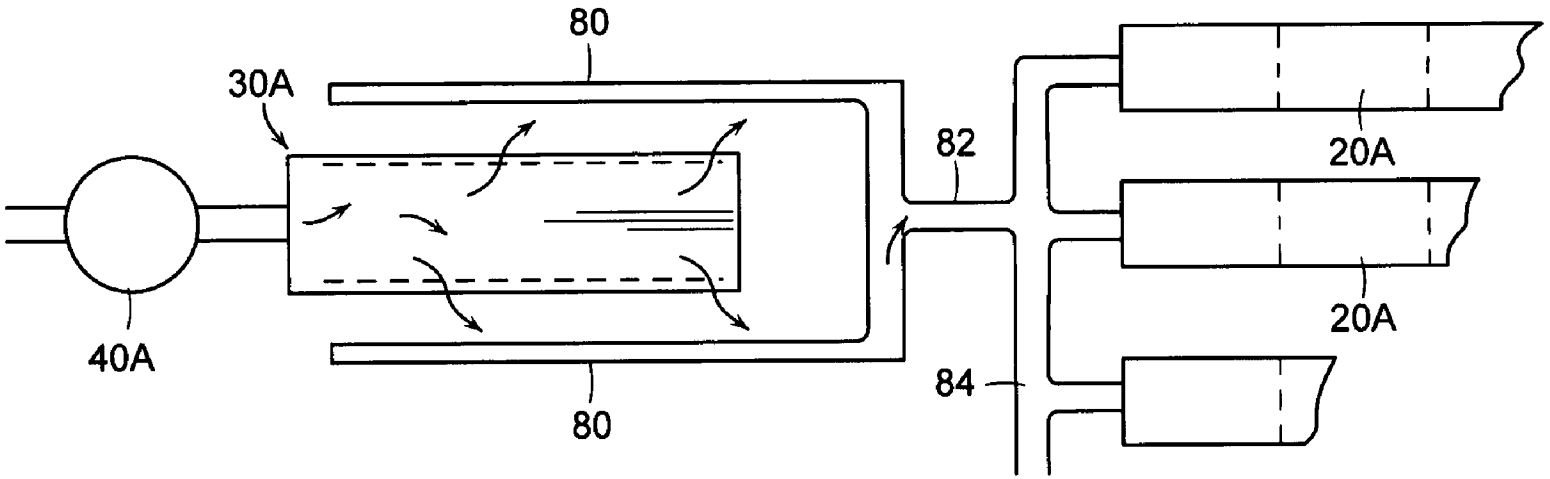
FIG. 4 is a plan view of another embodiment of stormwater handling system.

Other arrangements of the array 25 of chambers relative to the length of the SRS 30 can be used. For instance, referring to FIG. 1, there may be a second array of chambers to the left of SRS 30. In another arrangement, the chambers of the array may be perpendicular to the length of the SRS, rather than parallel as shown in FIG. 1. In another embodiment, illustrated schematically in FIG. 4, SRS 30A is more spaced apart from the array, but functions in a similar manner to that which has been described. As indicated by the arrows, water flows from diverter 40A into SRS 30A, and then sideways through the filter fabric and crushed stone media, to perforated collection pipes 80, which run to header 84 which distributes the water of an array 25A of chambers 20A. In another embodiment, there is no array 25, but simply a mass of permeable media. In still another embodiment, the array 25A is replaced by one or more collection pipe which discharges to a municipal system or other receiving point. While a gravity flow system has been described, within the generality of the invention, pumps may be used at one or more points along the flow path.

Although this invention has described with respect to one or more preferred embodiments, and by examples, they should not be considered as limiting the claims, since it will be understood by those skilled in the art that there may be made equivalents and various changes in form and detail, without departing from the spirit and scope of the claimed invention.

We claim:

1. Stormwater handling apparatus, for receiving stormwater from a surface drainage system, which comprises:

an array of chambers buried beneath the surface of the earth within permeable media, for receiving and dispersing stormwater; and, a solids retention subsystem, for receiving stormwater from said surface drainage system, for removing solids from the stormwater by a combination of settling and filtering, and for discharging the resultant partly clarified stormwater to said array;

wherein the solids retention subsystem is buried within and spaced apart from said array within said permeable media; and wherein stormwater discharged from the solids retention subsystem flows into said permeable media and then into said array.

2. The apparatus of claim 1, wherein the solids retention subsystem comprised a string of interconnected arch shape cross section chambers having perforated sidewalls.

3. The apparatus of claim 1, further comprising a low-permeability membrane running along the surface of permeable media lying within the arch shape cross section of at least one of said interconnected chambers of the solids retention subsystem.

4. The apparatus of claim 2 further comprising: geotextile running along the sidewalls of the chambers.

5. The apparatus of claim 4, wherein the arch shape cross section chambers of the solids retention subsystem have open bottoms, further comprising: geotextile running across the surface of permeable media lying within the arch shape cross section of the chambers of the solids retention subsystem, the geotextile having a coarser filtering property than the geotextile running along the sidewalls.

6. The apparatus of claim 4, wherein the solids retention subsystem is comprised of chambers having dissolved-pollutant capturing materials in vicinity of said sidewalls and geotextile.

7. The apparatus of claim 6, wherein said dissolved-pollutant capturing materials comprise materials for capturing hydrocarbons or metal ions.

8. The apparatus of claim 1, wherein the solids retention subsystem is comprised of a string of interconnected arch shape cross section chambers having a layer of geotextile layer running along the surface of permeable media lying within the arch shape cross sections of the chambers.

9. The apparatus of claim 1, wherein the solids retention subsystem is comprised of round cross section perforated pipe surrounded by a layer of geotextile.

10. The apparatus of claim 1 further comprising: a diverter, positioned upstream of said solids retention subsystem along the flow path of stormwater running from said surface drainage system to the solids retention subsystem, for channeling a portion of said running stormwater to said array when the stormwater inflow capacity of the solids retention subsystem is exceeded.

11. The apparatus of claim 10, wherein the diverter has a first outlet connected to the solids retention subsystem, and a second outlet connected to said array; wherein the second outlet is higher in elevation than the first outlet; the diverter further comprising means for preventing flow through said second outlet until the elevation of stormwater within the diverter rises to a level which is higher than the elevation of said first outlet.

12. The apparatus of claim 11 wherein said means for preventing flow through the second outlet is a weir within the diverter.

13. The apparatus of claim 11 wherein said means for preventing flow through the second outlet is a valve.

14. The apparatus of claim 1 wherein the solids retention subsystem has a length and wherein the array is comprised of a multiplicity of rows of chambers, the rows of the chambers running parallel to the length of the solids retention subsystem.

15. The apparatus of claim 1 wherein the permeable media is crushed stone.

16. The apparatus of claim 1, wherein at least a portion of the stormwater received by the array is dispersed from the array by flow of stormwater to an external stormwater receiving point, which apparatus further comprises: means for controlling water flowing from the chamber array to said external stormwater receiving point.

17. Stormwater handling apparatus, which comprises:

(a) subterranean solids retention subsystem means comprised of chambers buried within permeable media, for receiving stormwater flowed from a surface drainage system, for removing solids from the stormwater therein by a combination of settling and filtering, and for discharging the resultant partially clarified stormwater into the permeable media surrounding the subsystem;

(b) means for flowing said partially clarified stormwater through the permeable media into an array of one or more chambers spaced apart from the solids retention subsystem and buried within the permeable media, so the stormwater may be then detained within, percolated from, and or discharged from, the array of chambers.

18. The apparatus of claim 17 which further comprises: diverter means positioned upstream of subterranean solids retention subsystem for first receiving stormwater from the surface drainage system, and for flowing a portion of the stormwater directly into the chamber array when the flow of stormwater exceeds the flow capacity of the solids retention subsystem.

19. A method for handling stormwater, which comprises:

(a) flowing stormwater from a surface drainage system into a subterranean solids retention subsystem which is comprised of chambers buried within permeable media, removing solids from the stormwater therein by a combination of settling and filtering, and discharging the resultant partially clarified stormwater into the permeable media surrounding the subsystem;

(b) then flowing said partially clarified stormwater through the permeable media into an array of one or more chambers spaced apart from the solids retention subsystem and buried within the permeable media, so the stormwater may be then detained within, percolated from, and or discharged from, the array of chambers.

20. The method of claim 19 which further comprises: prior to step (a) first flowing the stormwater from the surface drainage system into a diverter which is upstream from the solids retention subsystem; and, flowing a portion of the incoming stormwater directly into the chamber array when the flow of stormwater exceeds the stormwater flow capacity of the solids retention subsystem.

* * * * *

UNITED STATES PATENT AND TRADEMARK OFFICE

CERTIFICATE OF CORRECTION

PATENT NO. : 6,991,734 B1
APPLICATION NO. : 10/813887
DATED : January 31, 2006
INVENTOR(S) : Jonathan F. Smith and Bryan A. Coppes It is certified that error appears in the above-identified patent and that said Letters Patent is hereby corrected as shown below:

In the Claims:

Column 1, line 3: please insert -- This application claims the benefit of U.S. Provisional Application 60/459,478, filed April 4, 2003. --
Column 3, line 59: please change "percolation" to -- percolates --.
Column 6: In Claim 1 line 3, after "chambers", please enter -- having perforated walls --.
Column 6: In Claim 1 line 7, please change "array" to -- permeable media --.
Column 6: In Claim 2 line 1, please change "comprised" to -- comprises --.
Column 6: In Claim 3 please change the dependency of Claim 20 to -- 21 --.
Column 7: In Claim 4, line 2, prior to "chambers", please insert -- solids retention subsystem --.
Column 7: In Claim 10, line 3, after "stormwater", please insert -- directly --.
Column 8: In Claim 17, line 7, after "chambers", please insert -- having perforated walls --.
Column 8: In Claim 19, line 7, after "chambers", please insert -- having perforated walls --.

Signed and Sealed this

Tenth Day of October, 2006

JON W. DUDAS
*Director of the United States Patent and Trademark Office*